United States Patent [19]

Bergström

[11] 4,430,769

[45] Feb. 14, 1984

[54] WINDOW CLEANING DEVICE

[75] Inventor: Arne Bergström, Nottebäck, Sweden

[73] Assignee: Rolf Altgenug Corporation, Jarfalla, Sweden

[21] Appl. No.: 321,711

[22] Filed: Nov. 16, 1981

[30] Foreign Application Priority Data

Nov. 17, 1980 [SE] Sweden ..... 8008056

[51] Int. Cl.[3] ..... A47L 1/06

[52] U.S. Cl. ..... 15/245; 15/236 R

[58] Field of Search ..... 15/245, 176, 146, 236, 15/145, 241; 30/169

[56] References Cited

U.S. PATENT DOCUMENTS

| | | | |
|---|---|---|---|
| 948,641 | 2/1910 | Bailey | 15/245 |
| 2,905,960 | 9/1959 | Ward | 15/245 |
| 4,027,353 | 6/1977 | Unger | 15/245 |
| 4,075,730 | 2/1978 | Siemund | 15/245 |

*Primary Examiner*—Philip R. Coe
*Assistant Examiner*—Michael Knick
*Attorney, Agent, or Firm*—Witherspoon & Hargest

[57] ABSTRACT

The present invention briefly refers to a window squeegee for use in washing windows and similar plane surfaces. It comprises a handle (1) having an attachment portion (3) for a scraper blade (4), the scraper blade being detachable secured to the attachment portion (3). The scraper blade (4) is constituted by a rubber blade (6) which is clamped between the legs of a metal strip (5) having substantially U-shaped cross-section. The attachment portion (3) is suitably comprising two protruding shoulders (9) adapted to contact one of the legs of the scraper blade strip (5) and at least one tongue (10) adapted to contact the other leg of the scraper blade strip (5). The tongue or tongues are provided with a ridge (11) protruding towards the scraper blade (4) and receiving in a notch (8) in the other leg of the scraper blade strip (5).

2 Claims, 6 Drawing Figures

WINDOW CLEANING DEVICE

The present invention relates to window scrapers or squeegees, in particular to a window squeegee having an exchangable scraper blade. Specifically the invention refers to that type of window squeegees having an exchangable scraper blade, the scraper blade of which consists of a rubber blade which is partly enclosed by a metal strip.

Fundamentally, a window squeegee comprises a handle, at present ordinarily made of plastic, and a scraper blade in some way attached thereto. The metal strip partly enclosing the scraper blade is attached to the handle, such as by screwing, riveting or clamping involving certain deformation so that the strip is prevented from moving laterally in the handle. The strip has a substantially U-shaped cross-section with a dilation at the bottom of the U. The rubber blade in this case is constructed as a rubber strip having a bead along the one edge and thus having a shape complementary to the shape of the U-shaped strip whereby the rubber strip is permitted to be inserted laterally from the narrow end of the metal strip.

When the window squeegee is passed over a glass window or corresponding surface, this is performed with such movements that the rubber blade will tend to get loose from the strip and, accordingly, the rubber blade must be locked within the metal strip. In order that both edges of the rubber blade may be used a metal clip has been provided at one end of the rubber blade. However, this metal clip only prevents the blade from sliding out of the metal strip in one direction whereas the blade may become detached from the metal strip in the opposite direction. In addition, such a clip involves the disadvantage that upon movement of the squeegee against the frame surrounding the glass window such frame may be damaged by the clip.

Another attempt to solve the problem involves attaching the rubber blade simultaneously with attaching the metal strip to the handle. However, this causes difficulties when the rubber blade is to be exchanged because it must be loosened from the attachment of the metal strip to the handle. However, this is not always possible and accordingly a window squeegee of the disposable type is obtained.

This known type of attachment also involves the disadvantage that the central portion of the rubber blade is exposed to tensions and similar stresses causing the blade to be differntially tensioned at its free edge and, due to this, the rubber blade will tend to form streaks during use.

As the metal strips should sustain a rather strong attachment to the handle, i.a. by screwing or riveting, and also should be able to serve in connection with many rubber blades in succession, the metal strip requires comparably high rigidity unnecessarily increasing the price thereof.

It is a purpose of the present invention to eliminate the abovementioned drawbacks, this purpose being achieved by a construction of the type indicated in the claims from which the specific features of the invention will appear.

Figure 1:
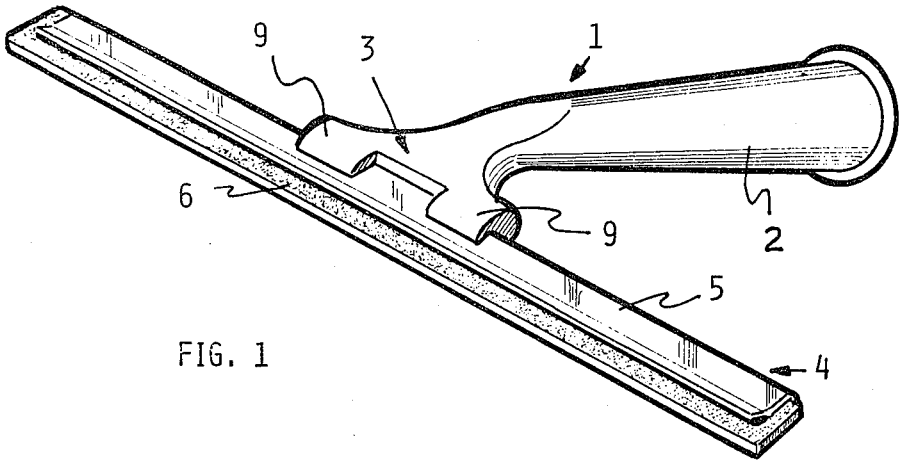
Figure 2:
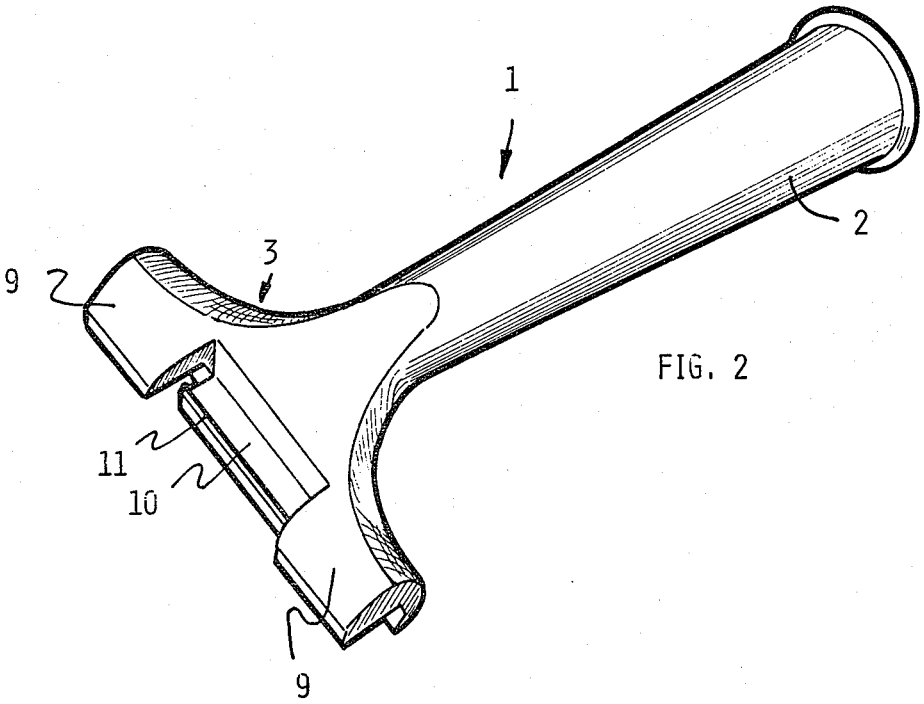
Figure 4:
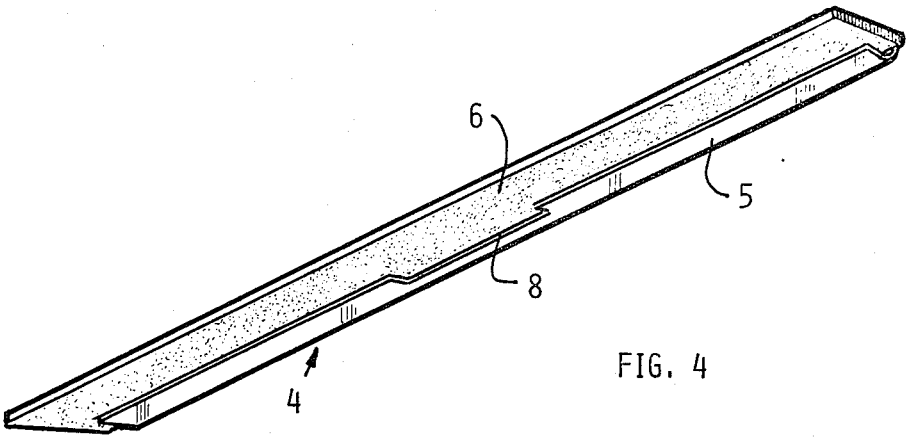
Figure 3:
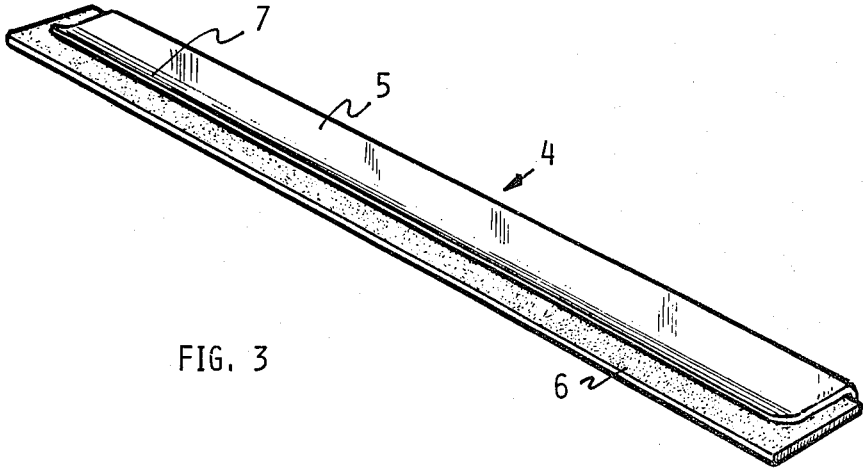
Figure 5:
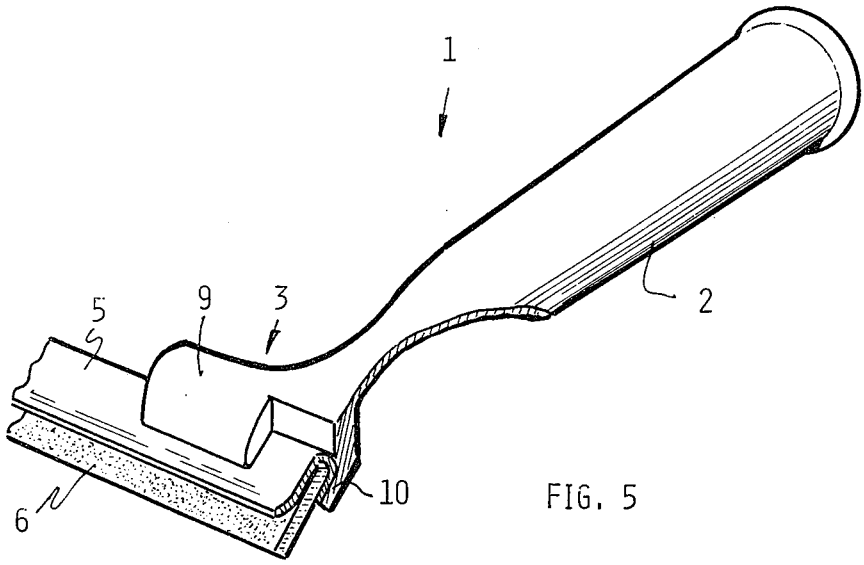
Figure 6:
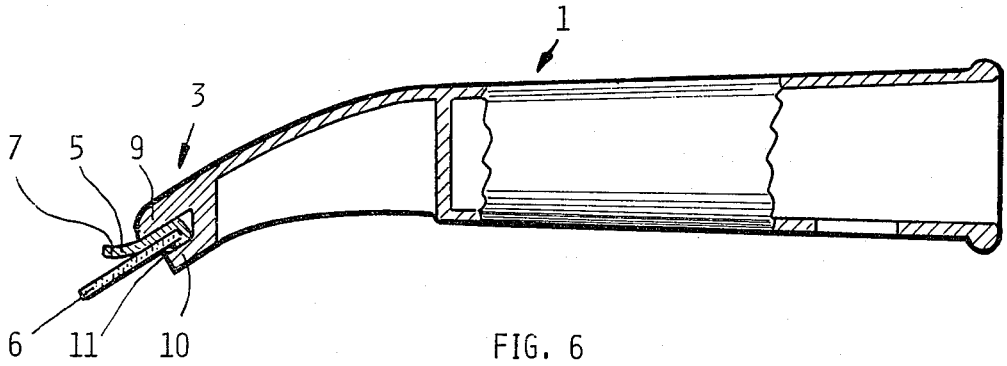

The invention is hereafter described in detail by reference to the attached drawings, in which FIG. 1 is a perspective view from above of a window squeegee according to the invention, FIG. 2 is a perspective view from above of a handle of a window squeegee according to the invention, FIG. 3 is a perspective view from above of a scraper blade according to the invention, FIG. 4 is a perspective view from below of the scraper blade shown in FIG. 3, FIG. 5 is a fragmentary, partly sectioned perspective view of a window squeegee according to the invention, and FIG. 6 is a fractionary section of the handle provided with a scraper blade according to the invention.

The handle 1 shown in FIGS. 1 and 2 comprises a tubular hand piece 2 and an attachment portion 3 for the scraper blade extending perpendicularly to the longitudinal axis of the tubular hand piece 2.

In FIGS. 3 and 4 there is shown the scraper blade 4 which comprises a plate strip 5 of substantially U-shaped cross-section and a rubber blade 6 inserted between the legs of the plate strip. At its free edge 7 one of the legs of the plate strip has a softly outwardly curved shape. The other leg of the plate strip is slightly shorter than the first leg and is pressure-biased against the opposite leg interiourly of the free edge 7 thereof so that the rubber blade 6 inserted between the legs is retained in its position within the plate strip.

In order to keep the weight of the window squeegee as low as possible the handle, as shown in FIG. 6, is substantially hollow. Also the attachment portion itself has a construction rendering it comparatively light.

Seen in section as in FIG. 6 the attachment portion also has the shape of a U, substantially corresponding to the outer shape of the plate strip 5. Seen as in FIG. 2 the attachment portion comprises two mutually spaced shoulders 9 extending from the handle and adapted to come into contact with the upper side of the scraper blade 4. In the interspace between the shoulders 9 there is provided an extending tounge 10 positioned below the level of the shoulders 9 as appears in particular from FIG. 6. This tongue 10 has a length corresponding to the cut-out portion 8 in the plate strip 5. The tongue 10 extends from the handle over a shorter distance than the shoulders 9 and is provided at its outer end with a ridge 11 extending towards the shoulders 9. The tongue 10 has a width substantially corresponding to the width of the leg of the srip 5 at the cut-out portion 8. This means that when the scraper blade 4 is in position in the handle 1, the ridge 11 will extend into the cut-out portion 8 and thereby prevent the scraper blade from being shifted laterally while at the same time the blade is rigidly retained in the handle.

The scraper blade 4 with its rubber blade 6 and strip 5 form a unit which is easily exchanged. By turning scraper blade 4 such that the free edge 7 is moved in a downward direction as shown in FIG. 6, the tongue 10 is displaced and the blade is detached. A new blade is inserted by the opposite movement while simultaneously it is urged inwardly into the attachment portion 3.

The work with the window squeegee is performed in the normal way and during operation the rubber blade 6 will be pressed up against the free edge 7 of the strip 5. The moment acting on the handle 1 and in particularly on the attachment portion thereof will be taken-up on the upper side of the scraper blade by the shoulders 9 which are of strong constructin while a lesser moment will be applied to the tongue 10, this moment being absorbed at the inner portion of the tongue.

Thus, due to the present inventiom there is obtained a window squeegee having low weight, simple construction and low price while simultaneously it permits repeated exchange of blades in a simple way without the use of tools; accordingly the purposes mentioned initially have been achieved.

What I claim is:

1. A window squeegee device comprising a handle having an attachment portion extending from one end thereof, and a squeegee blade assembly detachably connected to said attachment portion, said attachment portion including a generally U-shaped opening comprising a first and a second wall extending from a base, said first wall including two shoulders having a space therebetween, and said second wall including a tongue extending from said base opposite said space, the edge of said tongue furthest from said base including a ridge extending towards said space, said squeegee blade assembly comprising a U-shaped strip including a first and second leg pressure biased towards each other and extending from a strip base, for engaging a squeegee blade inserted between said first and second legs, the surface of each leg engaging the blade being planar, said first leg engaging said shoulders and said second leg including a cutout portion into which extends said ridge.

2. The window squeegee of claim 1 wherein said squeegee blade assembly includes a squeegee blade generally rectangular in cross-section having opposing working surfaces and being inserted into said U-shaped strip, one of said surfaces engaging said first leg and the other of said surfaces engaging said second leg and said tongue.

* * * * *